United States Patent [19]

Housman

[11] 4,184,803

[45] Jan. 22, 1980

[54] RELEASABLE BACKHOE BOOM LOCK

[75] Inventor: Richard D. Housman, Mediapolis, Iowa

[73] Assignee: J. I. Case Company, Racine, Wis.

[21] Appl. No.: 884,699

[22] Filed: Mar. 8, 1978

[51] Int. Cl.[2] ..... E02F 3/32

[52] U.S. Cl. ..... 414/694; 212/46 R; 414/722

[58] Field of Search ..... 214/130 R, 131 R, 138 R, 214/145 R, 132; 212/46 R; 414/680, 685, 694, 722, 687

[56] References Cited

U.S. PATENT DOCUMENTS

| | | | |
|---|---|---|---|
| 3,811,582 | 5/1974 | Shumaker | 214/138 R |
| 3,921,835 | 11/1975 | Baker | 214/138 R |

*Primary Examiner*—Stephen G. Kunin

*Assistant Examiner*—George F. Abraham

*Attorney, Agent, or Firm*—Dressler, Goldsmith, Clement, Gordon & Shore, Ltd.

[57] ABSTRACT

A releasable lock for locking a boom that is pivoted on a horizontal pivot axis on a frame disclosed herein. The releasable lock includes a pin or first member on the frame and a second member pivotally supported on the boom about a common pivot axis with one end of a unit fluid ram that has its opposite end connected to a material handling unit which is pivoted on the outer end of the boom. A releasable linkage includes linkage between the unit fluid ram and the second member with the linkage having a portion pivotally supported on the boom and arranged so that pivotal movement of the unit fluid ram away from the boom during actuation thereof will automatically release the lock.

6 Claims, 4 Drawing Figures

RELEASABLE BACKHOE BOOM LOCK

BACKGROUND OF THE INVENTION

The present invention relates generally to earthworking implements and more specifically to an improved releasable lock means for locking a boom on a frame.

Releasable lock means for preventing pivotal movement of a backhoe boom have been known for several years and examples of present day commercial releasable locks are disclosed in U.S. Pat. Nos. 3,811,582 and 3,921,835, both assigned to the assignee of the present invention. The first of these patents discloses a releasable lock for a backhoe unit that is supported on a frame which is pivotally supported on a base structure of a vehicle. The releasable lock is designed such that the boom is automatically locked to the frame when the boom is moved to a transport position and can be unlocked by manipulation of a unit fluid ram that pivots the material handling unit on the outer end of the boom.

The other of these patents also discloses a releasable lock in which a boom is automatically locked on a frame when the boom is moved to the transport position with a manual release mechanism allowing the operator to release the lock whenever movement of the boom is desired.

In both of these units, the boom and frame can be pivoted about the vertical pivot axis while the boom is locked on the frame. This arrangement is desirable because many times it becomes necessary to swing the boom even though the material handling unit is not being used for transferring materials.

While both units disclosed in the respective patents have been commercially successful, manufacturers are constantly striving to provide a simpler mechanism which can readily be incorporated into existing machinery without any major modifications thereof and at a reduced cost.

SUMMARY OF THE INVENTION

The releasable lock means of the present invention is specifically adapted for an earthworking implement having a boom pivoted on a frame about a horizontal pivot axis with a material handling unit pivoted intermediate opposite ends on an outer free end of the boom by a fluid ram unit having one element pivotally connected to the material handling unit at one free end thereof and a second element pivoted on the boom adjacent the frame. The releasable lock means is capable of automatically locking the boom on the frame when the boom is moved to a stored or transport position and will automatically be released when the fluid ram unit is manipulated.

More specifically, the releasable lock means includes a first member on the frame and a second member pivoted on the boom with a toggle linkage between the fluid ram unit and the second member that will automatically pivot the second member away from the first member when the fluid ram unit is actuated and pivots away from the boom. The linkage also incorporates a spring biasing mechanism that automatically defines a neutral intermediate position for the linkage which accommodates movement of parts of the linkage in opposite directions from a neutral intermediate position when external forces are applied to the linkage system.

DETAILED DESCRIPTION

Figure 1:
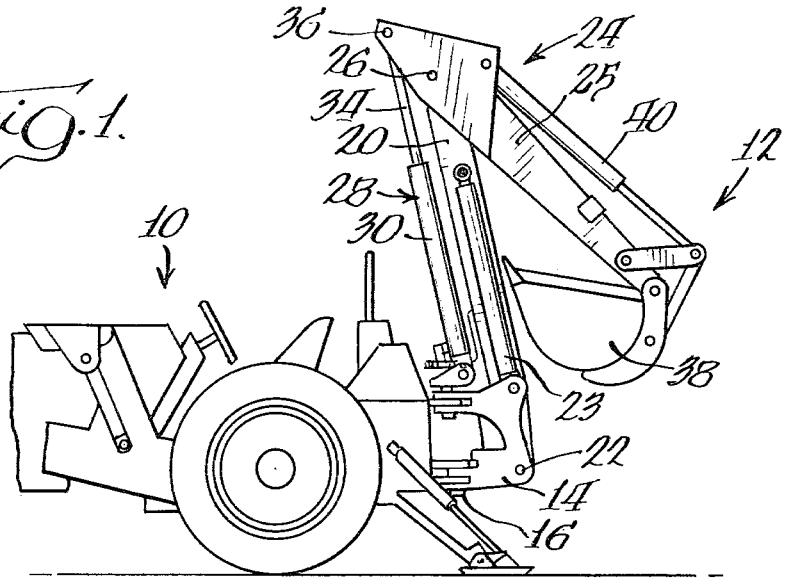
FIG. 1 shows a fragmentary portion of the rear end of a vehicle with an earthworking implement supported thereon and a releasable lock means of the present type incorporated therein.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

FIG. 1 of the drawings shows a vehicle, generally designated by the reference numeral 10, having an earthworking implement 12 supported on the rear end thereof. Earthworking implement 12 consists of a frame or swing tower 14 that is pivoted on the rear end of vehicle 12 through vertical pivot pins, generally designated by numeral 16. The swing tower or support is adapted to be pivoted about the vertical pivot axis defined by pins 16 through fluid rams (not shown).

Earthworking implement 12 also includes a boom 20 that has one end pivoted on a horizontal pivot pin or axis 22 on frame 14 through fluid rams 23 (only one being shown). A material handling unit, such as a dipper stick assembly 24, includes a boom element 25 that is pivoted intermediate its ends by pivot pin 26 on the outer free end of boom 20 through a fluid ram unit 28. Fluid ram unit 28 includes one element or a cylinder 30 pivoted on boom 20 through a pivot pin 32 that extends through a lug 34 which forms part of boom 20. A second element or piston rod 35 of fluid ram unit 28 is pivotally connected by a pin 36 to a free end of dipper stick assembly 24. Dipper stick assembly 24 also includes a bucket 38 pivoted on the opposite free end thereof through a further fluid ram 40.

The earthworking implement so far described is preferably of the type disclosed in U.S. Pat. No. 3,376,984, which is assigned to the assignee of the present invention. The disclosure of this patent relates to what is referred as an "overcenter" boom wherein the boom is swung to a transport or storage position that is generally vertical and slightly forward of a vertical axis extending through the pivot axis for the boom on the frame or support.

Usually these types of vehicles also have a further earthworking unit in the form of a front end loader (not shown) associated with the opposite end of the vehicle. Thus, many times it is desirable to lock or restrain the boom in the raised position, such as when the vehicle is involved in other operations where the backhoe is not being used, is transported from one site to another or is sitting idle.

According to the present invention, releasable lock means generally of the type disclosed in the above mentioned U.S. Pat. No. 3,921,835 are incorporated into the earthworking implement and the mechanism is designed such that the releasable lock means can be locked and unlocked by manipulation of the respective fluid rams that form part of the earthworking implement. The releasable lock means is most clearly illustrated in FIG. 2 and consists of a first member or pin 50 that is preferably an integral extension of the upper vertical pin 16 which defines the vertical pivot axis for the frame 14 on the remainder of the vehicle or base. A second member or ring structure 52 is adapted to cooperate with the first member or upper free end portion 50 of pin 16 to define the lock means between frame 14 and boom 20. The second member 52 consists of a generally horizontal plate 54 that has an opening 56 and opposite ends of the horizontal plate are connected to a pair of lugs 58 (FIG. 3). Lugs 58 are pivotally supported on pivot pin 32 which also defines the pivotal support for the cylinder 30 of fluid ram 28. Thus, the second member or ring structure 52 is pivoted on a common pivot with fluid ram unit 28 on boom 20.

According to the present invention, a linkage system is interposed between fluid cylinder 30 and the second member or pivoted member 52 and the linkage system is designed to automatically allow the members 50 and 52 to be interlocked when the boom is moved to the transport or storage position and to be released by manipulation of fluid ram 28.

More specifically, the linkage system includes a first member 60 that is fixed to the boom lug 34 and defines a pivot axis 62 for a toggle linkage which directly interconnects fluid cylinder 30 with second member 52. In the illustrated embodiment, the toggle linkage includes a first link 64 (FIGS. 2 and 3) that is pivoted at one end on a pin 66 defined on a lug 68 which is secured directly to fluid cylinder or second element 30. The opposite end of link 64 is connected through a pin 70 to one arm 71 of a bell crank 72 which has a sleeve 73 rotatably supported on pivot axis or pin 62. The bell crank 72 may be considered a link that is pivoted intermediate its ends on boom 20 through pin 62. The opposite or second arm 74 of the bell crank 72 is connected to member 52 through an operative connection 80 which will now be described.

Operative connection or biasing means 80 consists of a rod or link 82 (FIG. 2) which has one end connected to a plate 58 through a pin 84 and an intermediate portion fixedly connected to a sleeve 86 which is pivoted on the free end of arm 74. A first spring 90 is interposed between one end of rod 82 and sleeve 86 while a second spring 92 is interposed between the opposite end of rod 82 and sleeve 86. Adjustable nuts 94 are threaded on opposite ends of rod 82 to hold the springs and accommodate adjustment of the tension of the respective springs 90 and 92. The tension on the respective springs is adjusted such that there is an approximately equal force applied to both sides of sleeve 86 to define a center intermediate neutral position of rod 82 with respect to sleeve 86 when second member 52 is in the first position illustrated in FIG. 2.

The automatic latching and unlatching of the two members 50 and 52 is believed to be understood from the above description but will be briefly summarized at this point. When it is desired to lock the boom 20 to frame or support 14, the fluid ram 28 is initially manipulated, by extending the elements thereof to position the dipper stick assembly 24 to the extreme "undercurl" position illustrated in FIG. 1 while the boom extends generally upwardly and rearwardly (away from the stored position illustrated in FIG. 1). This will position the fluid ram 28 generally parallel to the axis of the boom 20.

Figure 2:
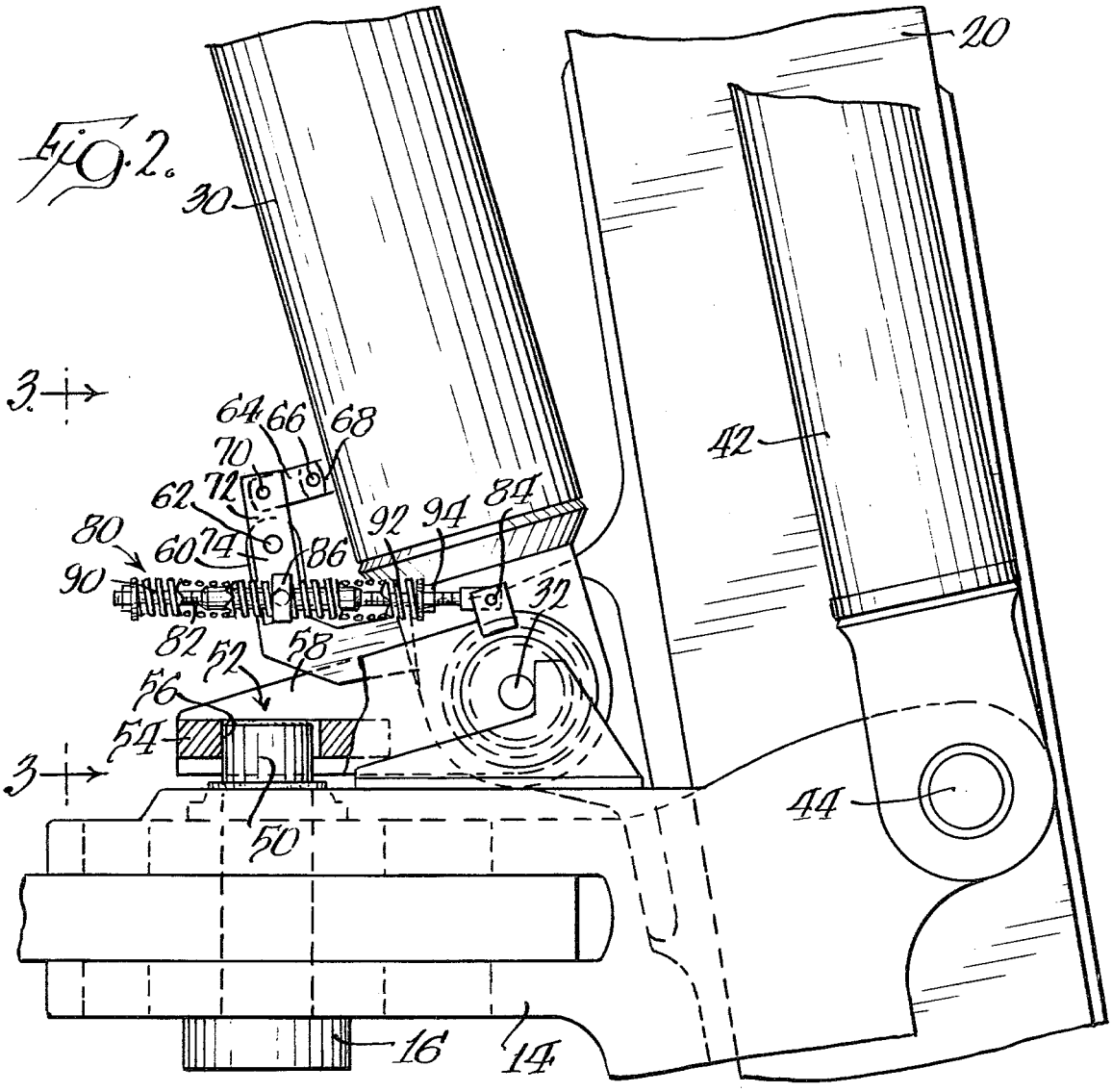
FIG. 2 is an enlarged fragmentary view of the lower portion of the earthworking implement shown in FIG. 1.
Figure 3:
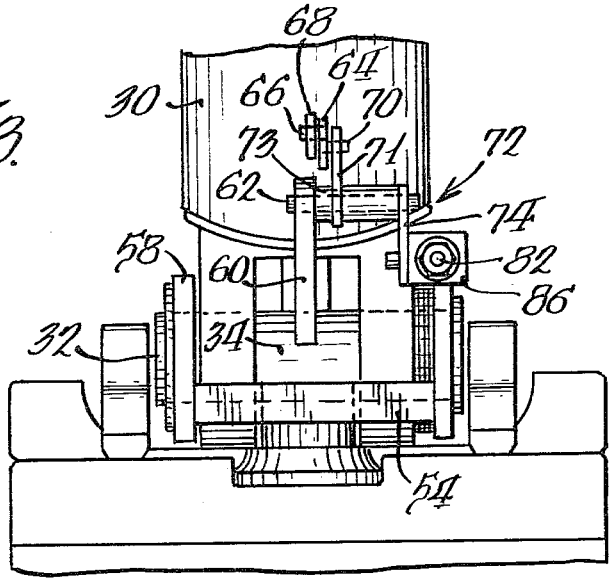
FIG. 3 is an end view as viewed along line 3—3 of FIG. 2.

As the boom is then raised to the stored or transport position, the lower surface of plate 54 will initially engage the upper free end of pin 50 and will cause the member 52 to pivot in a generally clockwise direction as viewed in FIG. 2. This clockwise movement will produce a compression of spring 90. Once the opening 56 in second member 52 is aligned with pin 50, the force of spring 90 will move the second member and remaining elements including spring 92 and rod 82 to the position illustrated in FIG. 2 wherein the pin 50 is located within the opening 56. All of this occurs while the remainder of the linkage including the bell crank 72 remains generally in the position illustrated in FIG. 2. This means that the boom can automatically be locked in the stored position without manipulation of any control levers other than control levers for fluid rams 28 and 23.

Figure 4:
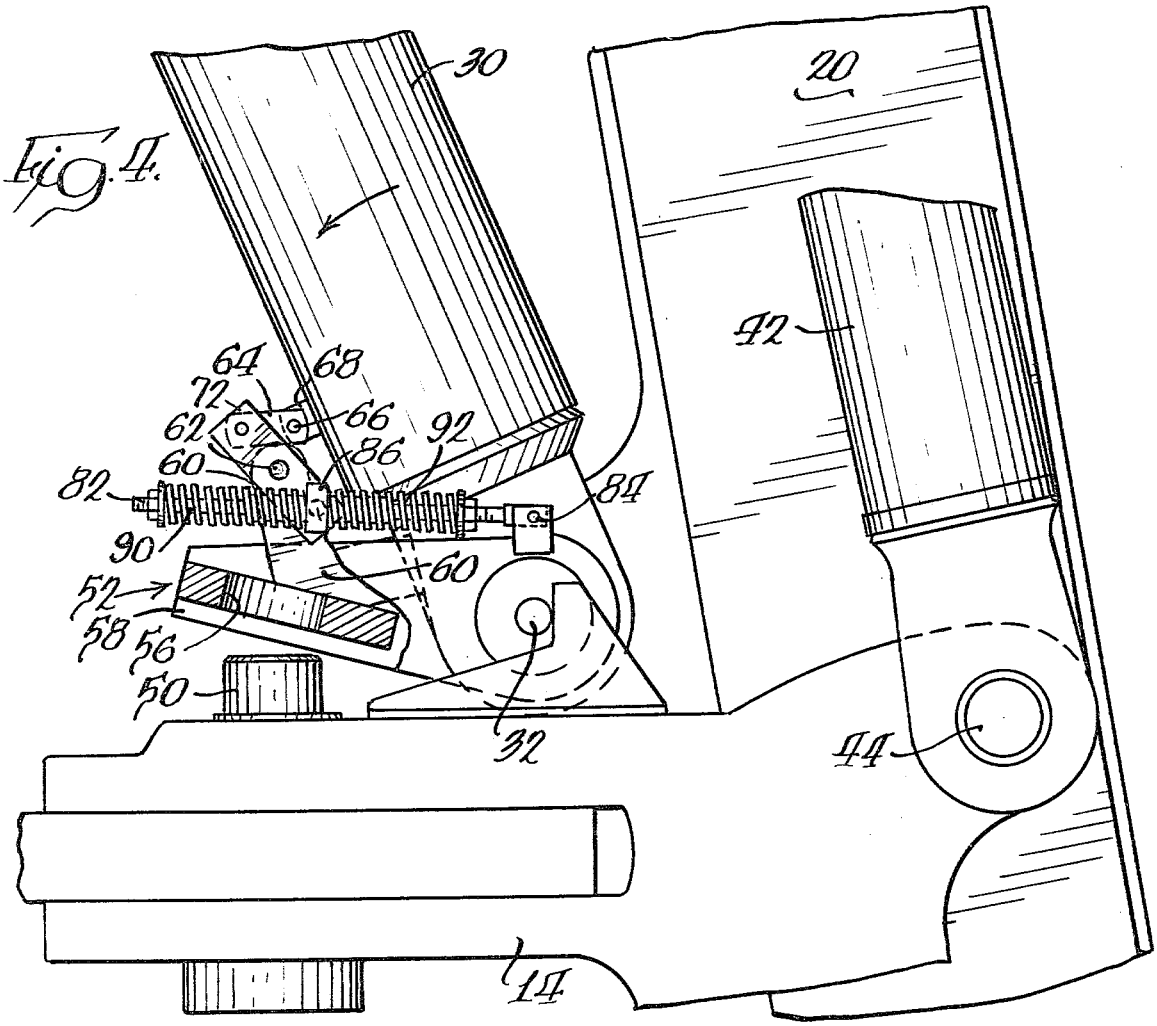
FIG. 4 is a view similar to FIG. 2 showing the manner in which the releasable lock means can be unlatched.

If it is desired to disengage the latch or the releasable lock, it is only necessary for the operator to manipulate the control lever for controlling flow of fluid to ram 28 to retract the fluid ram slightly which will cause the fluid ram, particularly cylinder 30 to pivot away from boom 20 from the position illustrated in FIG. 2 to the position illustrated in FIG. 4. During this pivotal movement of cylinder 30 about pivot pin 32, the linkage including link 64 and bell crank 72 are pivoted from the position illustrated in FIG. 2 to that illustrated in FIG. 4. If the opening 56 of member 52 is centered with respect to pin 50, the second member 52 will automatically pivot to the second position illustrated in FIG. 4 and release the latch means. However, should the periphery of the opening be in engagement with pin 50 to prevent such pivotal movement, member 52 will remain in the position illustrated in FIG. 2 while spring 92 becomes compressed. Thus, by proper manipulation of fluid rams 23, the boom can be moved around to release second member 52 and spring 92 will automatically pivot the member to the second position. The boom can then be lowered to its normal used position.

The present invention thus provides a very simple, compact, automatic releasable latch between the boom and the frame or support. Furthermore, by utilizing the upper end of pivot pin 16 as part of the boom lock, the boom and remainder of the material handling unit can be pivoted about the vertical axis defined by pivot pins 16 while the boom is in a locked position.

What is claimed is:

1. In an earthworking implement having a boom pivoted on a frame about a horizontal pivot axis, a material handling unit pivoted intermediate opposite ends on an outer free end of said boom by a fluid ram unit having one element pivotally connected to said material handling unit at one free end thereof and a second element pivoted on said boom adjacent said frame, and releasable lock means for locking said boom on said frame to prevent pivotal movement about said horizontal pivot axis, the improvement of said releasable lock means comprising a first member on said frame and a second member pivoted on a common pivot axis with said second element on said boom, and a linkage between said fluid ram unit and said second member, said linkage including at least a first link pivoted on said fluid ram unit adjacent said frame and interconnection means between said first link and said second member causing said second member to pivot away from said first member when said fluid ram unit is actuated and pivots away from said boom to release said lock means.

2. An earthworking implement as defined in claim 1, in which said interconnection means includes a second link pivoted intermediate its ends on said boom and spaced from said common pivot with one end of said second link pivotally connected to said first link and an opposite end operatively connected to said second member at a location spaced from said common pivot.

3. An earthworking implement as defined in claim 2 in which said operative connection includes biasing means defining a neutral position for said second member with respect to the opposite end of said second link.

4. An earthworking implement as defined in claim 3, in which said operative connection includes a third link interposed between said second member and the opposite end of said second link with said biasing means including first and second springs respectively interposed between said second and third links.

5. In an earthworking implement having a boom pivoted about a horizontal pivot axis on a support with an earthworking unit pivoted intermediate opposite ends on the free end of said boom through a fluid ram having one end pivoted on said boom and an opposite end pivoted on a free end of said earthworking unit, said support being pivoted about a vertical pivot axis on a base with said vertical pivot axis being defined by at least one pin fixed to said support and rotatable on said base, and releasable lock means between said boom and said support, said releasable lock means including a first member on said support, a second member on said boom, said second member including a ring structure pivoted about a horizontal pivot axis on said boom and including an opening within its confines for receiving said first member, said first member being an upper free end portion of said at least one pin, biasing means cooperating with said second member for normally maintaining said second member in a first position and accommodating movement from said first position, said members being positioned so that pivotal movement of said boom to a storage position will produce engagement between said members and cause movement of said second member from said first position, said biasing means returning said second member to said first position when said first member is aligned with said opening, and release means for moving said second member from said first position and separate said members, the improvement of said release means including a toggle linkage between said fluid ram and said second member, said toggle linkage being pivoted on said boom and pivotally connected to said fluid ram and said second member.

6. An earthworking implement as defined in claim 5, in which said biasing means is interposed between a pair of links of said toggle linkage and normally maintains said pair of links in an intermediate position, said biasing means accommodating relative movement of said pair of links in either direction from said intermediate position.

* * * * *